US012449220B1

(12) United States Patent
Russell

(10) Patent No.: US 12,449,220 B1
(45) Date of Patent: Oct. 21, 2025

(54) SUPPRESSOR COVER FOR RIFLE

(71) Applicant: Michael Curtis Russell, Graham, WA (US)

(72) Inventor: Michael Curtis Russell, Graham, WA (US)

( * ) Notice: Subject to any disclaimer, the term of this patent is extended or adjusted under 35 U.S.C. 154(b) by 0 days.

(21) Appl. No.: 18/930,916

(22) Filed: Oct. 29, 2024

(51) Int. Cl.
*F41A 21/44* (2006.01)
*F41A 21/30* (2006.01)

(52) U.S. Cl.
CPC ..... *F41A 21/44* (2013.01); *F41A 21/30* (2013.01)

(58) Field of Classification Search
CPC ..... F41A 21/44; F41A 13/12; F41A 21/30
See application file for complete search history.

(56) References Cited

U.S. PATENT DOCUMENTS 1,551,617 A * 9/1925 Pohlmann ..... F41A 13/12 89/14.1
3,075,314 A * 1/1963 Bakker ..... F41A 21/24 42/71.01
4,753,154 A * 6/1988 Higashi ..... F41A 13/12 165/104.26
4,762,048 A * 8/1988 Higashi ..... F41A 13/12 165/47
8,397,615 B2 * 3/2013 Poling ..... F41H 3/02 89/14.3
10,126,084 B1 * 11/2018 Oglesby ..... F41A 21/30
10,712,114 B2 * 7/2020 Roberts ..... F41A 13/12
11,150,045 B1 * 10/2021 Oglesby ..... F41A 21/30
11,644,265 B1 * 5/2023 Oglesby ..... F41A 21/44 89/14.4
11,920,884 B1 * 3/2024 Lee ..... F41A 21/34
2019/0072354 A1 * 3/2019 Lee ..... F41A 21/325
2019/0271520 A1 * 9/2019 Roberts ..... F41A 13/12
2021/0180903 A1 * 6/2021 Markut ..... F41A 21/484
2021/0404761 A1 * 12/2021 Le Sage ..... F41A 21/44

* cited by examiner

*Primary Examiner* — Derrick R Morgan
(74) *Attorney, Agent, or Firm* — Vista IP Law Group LLP

(57) ABSTRACT

A suppressor cover for a rifle has a first panel and a second panel that combine to form a tube, and a collar configured to wrap around the forward end of the tube. The panels have locking tabs configured to mate with corresponding rail slots on the rifle's handguard. The panels may have air vents.

20 Claims, 9 Drawing Sheets

SUPPRESSOR COVER FOR RIFLE

FIELD OF THE INVENTION

The present invention relates generally to firearms, and more particularly to a suppressor cover and methods of use.

BACKGROUND

The structure and operational mechanics of rifles are well-known. Some rifles are equipped with suppressors which can reach temperatures of over 2000 degrees Fahrenheit during use. To help protect the suppressor from physical damage and to reduce the likelihood of injury from inadvertent contact with a heated suppressor, suppressor covers (a.k.a. suppressor shields) are used. Such covers can be cloth-style (e.g., NOMEX), silicone, carbon fiber, or other material designed to withstand the high temperatures.

Cloth-style and silicone covers snugly wrap around the suppressor and are secured by straps or bands. Such covers typically lack ventilation and thus inhibit heat dissipation, requiring more time for the suppressor and cover to cool off. This leads to prolonged heat cycles, which can degrade the metal suppressor at a molecular level and/or the suppressor cover itself. Such covers are also awkward to install and may be more easily displaced by vibrations, weather elements, and/or other physical contact.

Known carbon fiber tubelike covers shroud the suppressor and may provide ventilation. Such covers, however, typically require mechanical connections to the handguard of the rifle using clips or other additional parts, often with tools, thus complicating installation, repair, and maintenance.

Extended handguards can also act as a suppressor cover. Such extended handguards may serve well to protect the suppressor, but since handguards (including the extended portions) are metal, even with heat vents they still pose a risk of injury from inadvertent contact therewith during the cooling down cycle. With extended handguards, heat is also undesirably wicked towards the shooter along the metal rifle parts.

Therefore, there is a need for a durable suppressor cover that is easy to install without tools and also facilitates ventilation.

Terminology

In embodiments of the invention described herein, the suppressor cover (200) has two panels (10*a* and 10*b*) each with many analogous components and features. When reference is made to a component or feature of a specific panel (10*a* or 10*b*), the corresponding "a" or "b" suffix is used respectively. However, when reference is made to the component or feature generally of either or both panels (10*a*, 10*b*), for simplicity the suffix is dropped. For example, reference to a "panel (10)" or "panels (10)" refers to either or both of panels (10*a*, 10*b*) as applicable.

SUMMARY

The present invention relates to a suppressor cover for a rifle having a suppressor. In the described embodiments, the cover has two panels each with corresponding forward and rearward ends and a locking tab at the rearward end. The panels mate with each other to form a tube configured to cover the suppressor, and the locking tabs are configured to interlock into rail slots on the rifle's handguard. The cover also includes a collar configured to wrap around the forward end of the tube.

One or both panels may each have one or more air vents to allow heat from the suppressor to dissipate therethrough. The rearward ends of the panels include stepped down portions so as not to block other rail slots and further stepped down portions to facilitate the locking tabs interlocking with the rail slots. A ledge extends rearwardly from the locking tabs to further facilitate the interlocking. The forward end of the tube has a circumferential recess to receive the collar. The locking tabs are integrated with the corresponding panels or otherwise attached thereto.

The collar is a silicone or other elastic band, a clamp, a clip, a bracket, or other mechanical structure to maintain the mating configuration of the two panels. In one embodiment, the collar comprises two pieces configured to mate with each other to form a ring. In one embodiment, the two pieces are each generally C-shaped with stepped up wall portions, and the terminal ends of the C-shape of each piece are configured to abut against the stepped-up wall portion of the other C-shaped piece.

These and other embodiments and aspects of the invention are described more fully herein, with reference to the drawings.

DETAILED DESCRIPTION

Figure 1:
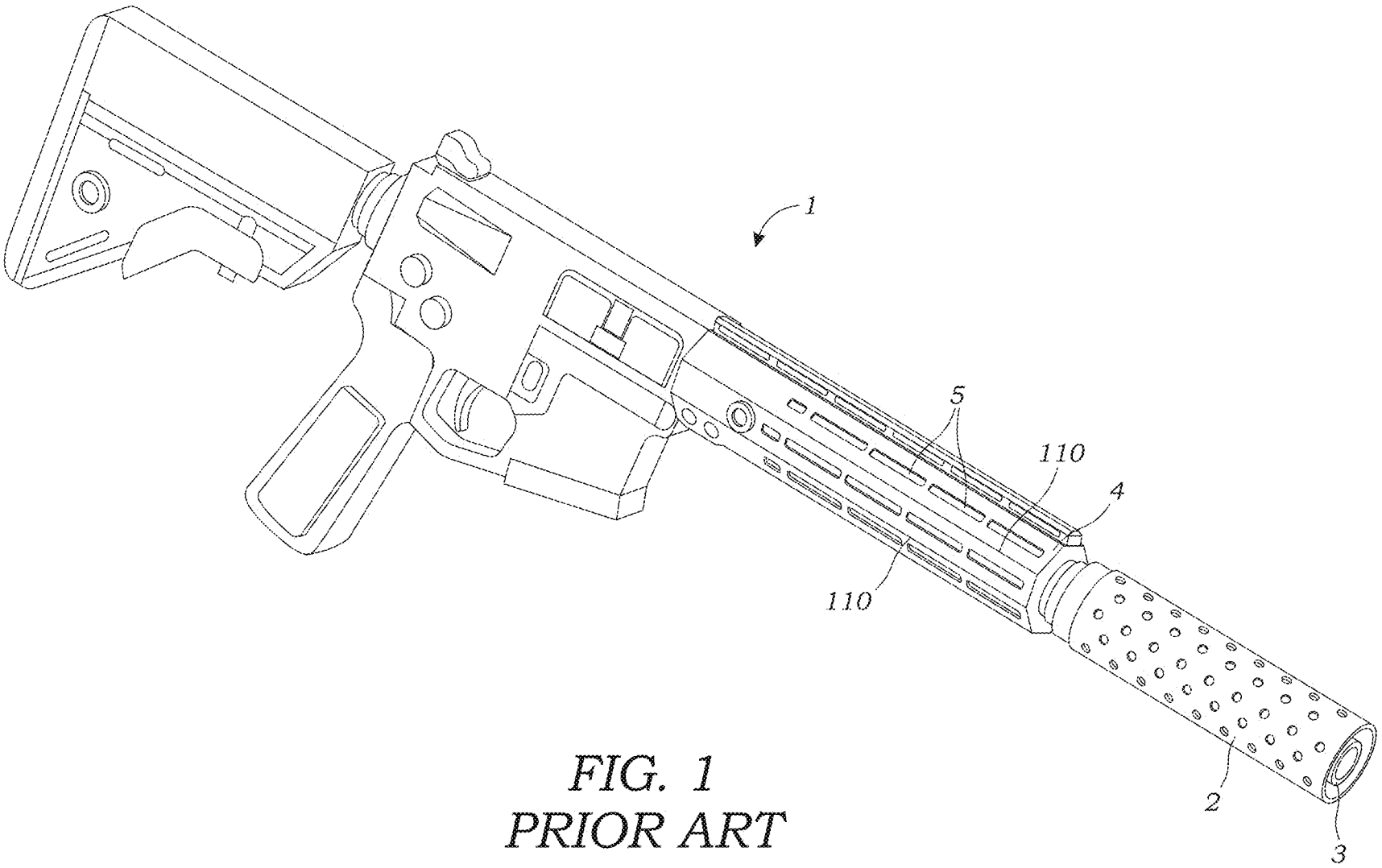
FIG. 1 PRIOR ART
FIG. 1 is a perspective view of a PRIOR ART AR-style rifle with a suppressor.
Figure 11:
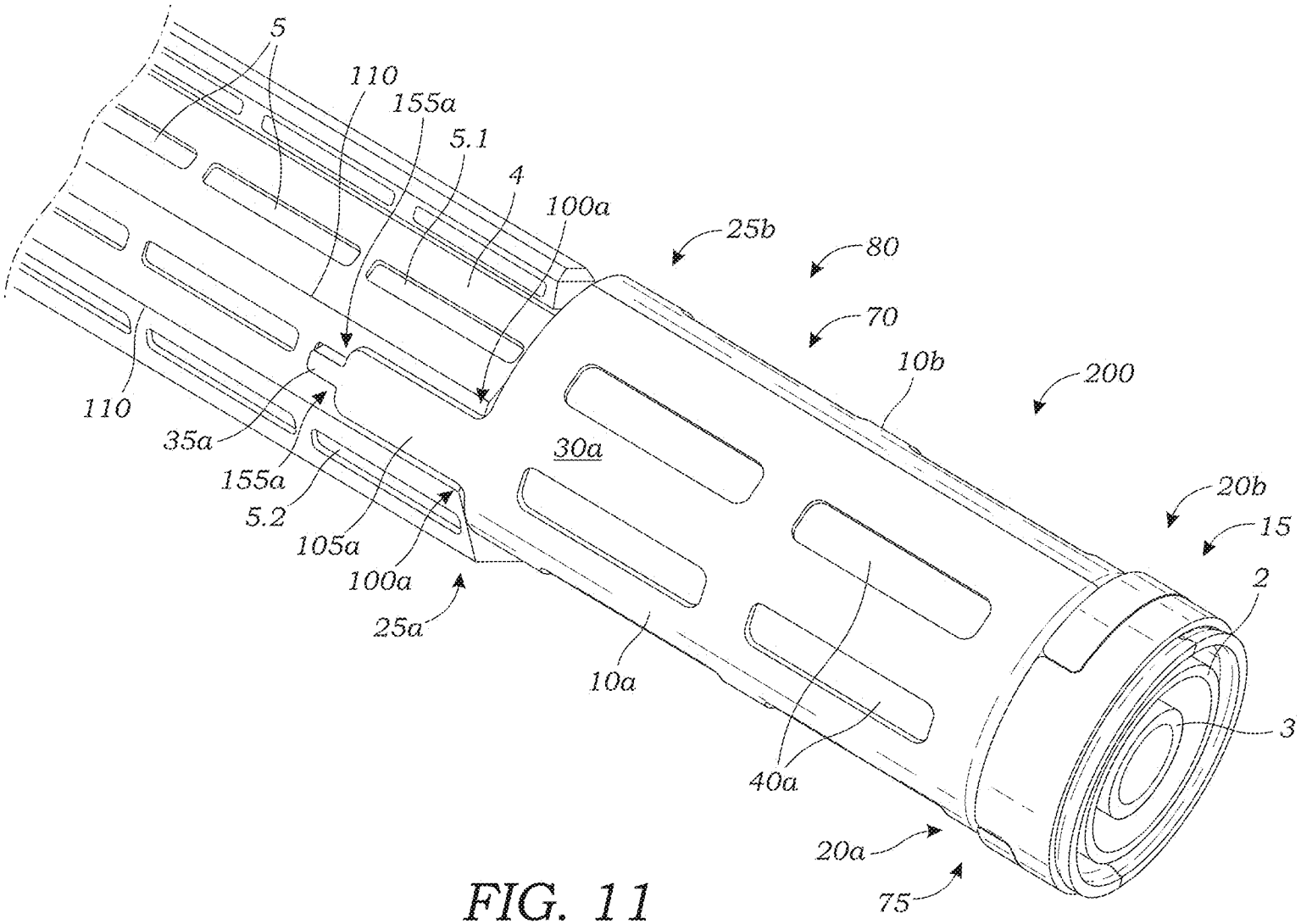
FIG. 11 is a close-up view of the suppressor cover of FIG. 8, installed on the rifle of FIG. 1.

The present invention relates to a suppressor cover (200) for a rifle (1). FIG. 1 shows a typical AR-style rifle (1) with a suppressor (2) installed over the barrel (3). The rifle (1) has a handguard (4) with rail slots (5), also well-known in the art. One embodiment of a suppressor cover (200) in accordance with the present invention is shown in FIG. 11, installed on the rifle (1) of FIG. 1. This embodiment, as well as others, will be described herein in more detail.

The suppressor cover (200) includes two panels (10) and a collar (15). The panels (10) of one embodiment of the present invention are shown in FIGS. 2, 3, 4, 5, 8, and 11. Each panel (10) has a forward end (20) and a rearward end (25), named for convenience to refer generally to the areas oriented at the forward portion of the suppressor (2) and the rearward portion of the suppressor (2) respectively. The panels (10) are made from any suitable material that is durable enough to maintain structural integrity and also withstand the extreme heat emanating from the suppressor (2). Carbon fiber is an example of a suitable material because carbon fiber is extremely lightweight yet incredibly durable and heat-resistant. These characteristics make carbon fiber ideal for prolonged use in training or operational scenarios, as compared to other materials which may degrade or become cumbersome.

Figure 2:
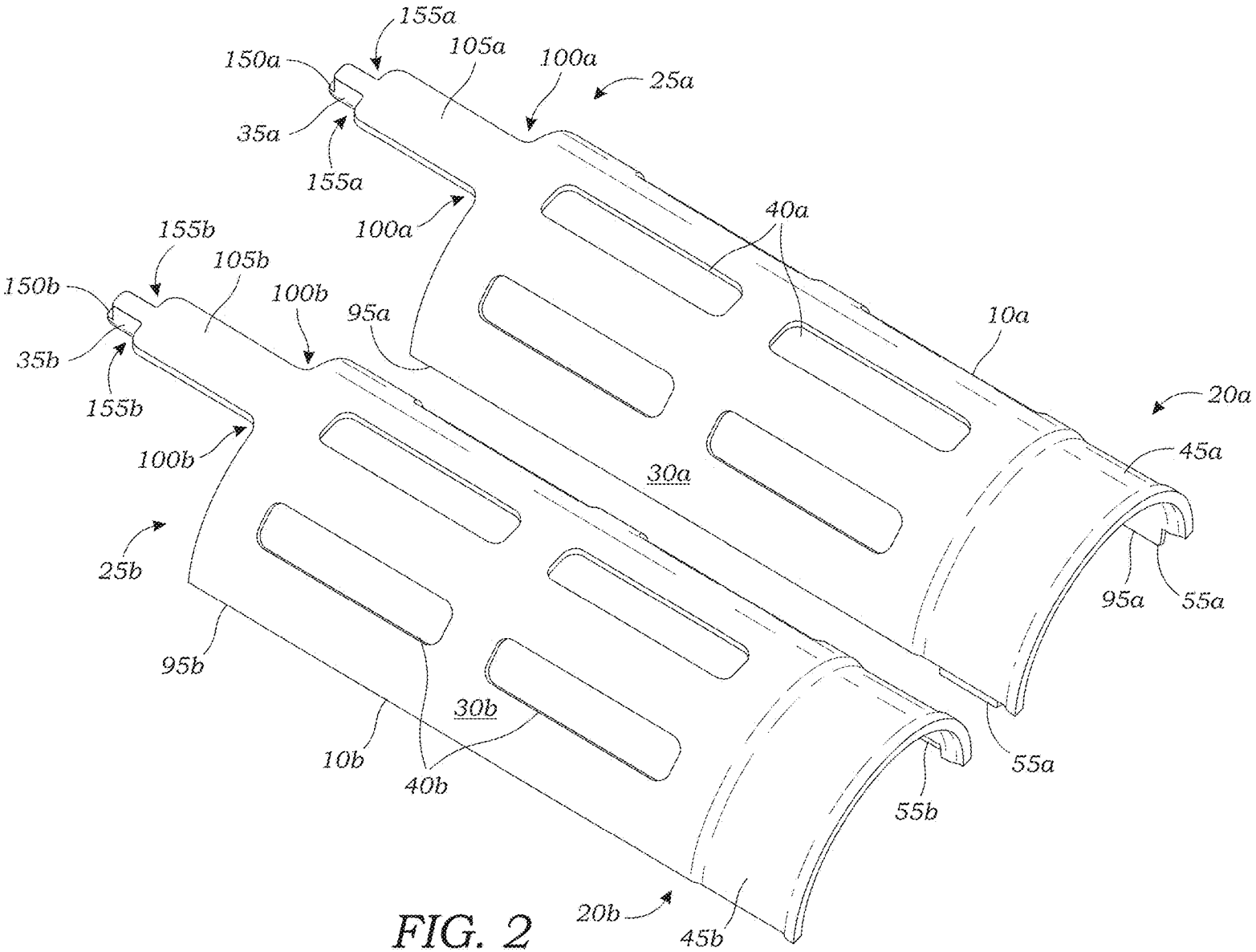
FIG. 2 is a perspective view of the outer surfaces of panels of a suppressor cover in accordance with an embodiment of the present invention, unassembled.
Figure 3:
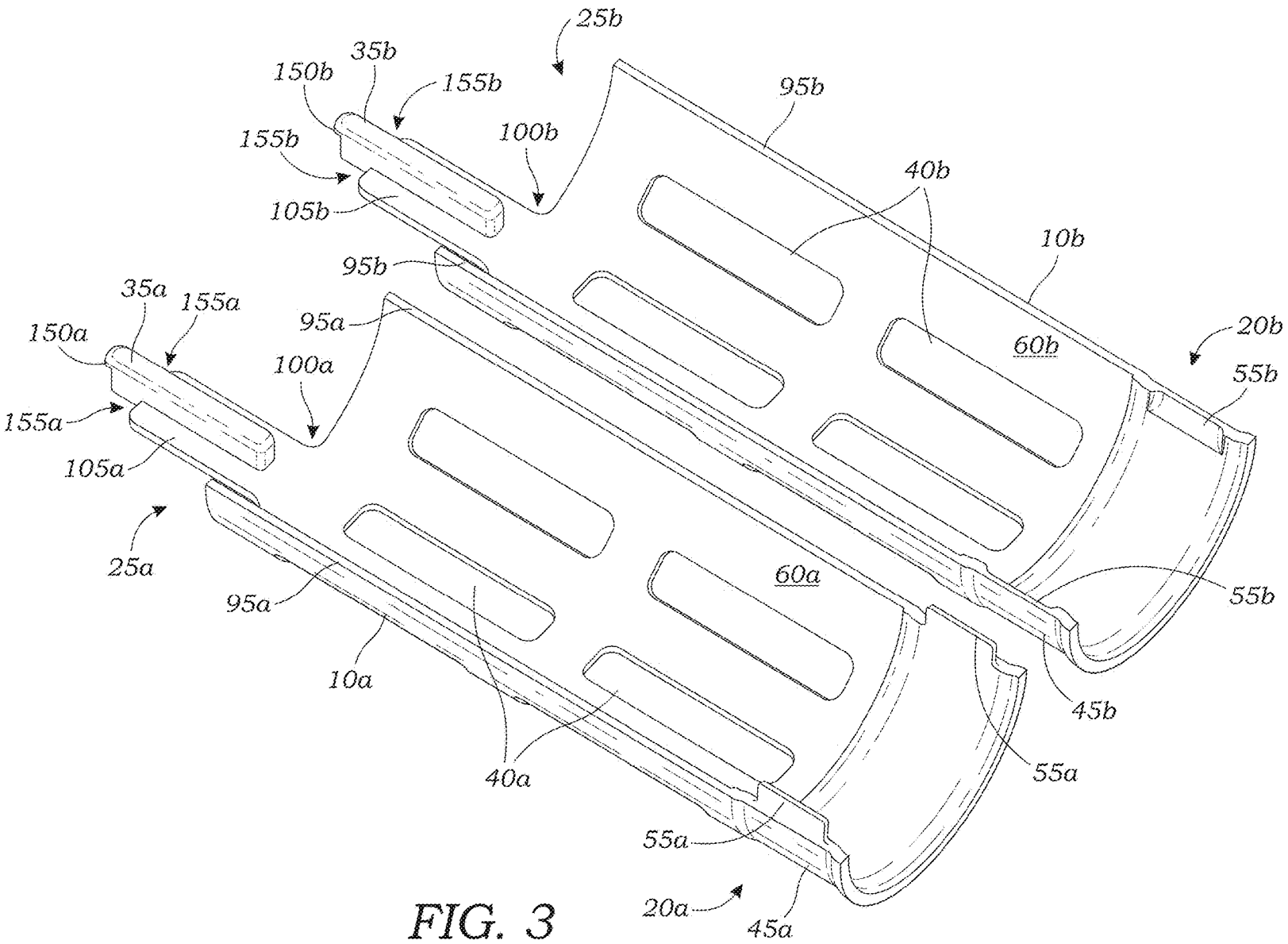
FIG. 3 is a perspective view of the inner surfaces of the panels of FIG. 2, unassembled.

Turning to FIG. 2, a view of the outer surfaces (30) of the panels (10) is shown with the panels (10) side by side, unassembled. FIG. 3 shows a view of the inner surfaces (60) of the panels (10) of FIG. 2. Each panel (10) includes a locking tab (35) at the rearward end (25) and a recess (45) at the forward end (20). The locking tabs (35) are configured to interlock with rail slots (5) on the handguard (4) of the rifle (1) as further described herein. The recesses (45) combine to form a circumferential recess (50) (see FIGS. 4-5) at the forward end of the suppressor cover (200) when assembled, as further described herein.

The panels (10) include air vents (40) to allow heat from the suppressor (2) to dissipate during and immediately after use. The drawings show each panel (10) having four generally rectangular-shaped air vents (40) oriented longitudinally and evenly spaced. However, the quantity, location, size, shape, and orientation of the air vents (40) on each panel (10) may vary and need not be the same. For example, one or both panels (10) may have zero, dozens, or even hundreds of air vents (40). The air vents (40) may be shaped as small circular holes, straight, curved, or zig-zagged lines, or any combination of the aforementioned. The patterns may be for aesthetics and/or functionality, e.g., to minimize debris or fingers from entering the radial gap between the suppressor cover (200) and the suppressor (2).

The panels (10) have complimentary positioning hardware (55) to help align the panels (10) during assembly and to help stabilize the suppressor cover (200) during installation and use. In the embodiment shown in the drawings, positioning tab (55*a*) on panel (10*a*) is configured to mate with positioning notch (55*b*) on panel (10*b*). Other hardware (55) may be used including protrusions and depressions, tongue and groove, interlocking teeth, pin and bore, ball and socket, etc. Typically, the positioning hardware (55) is machined, printed, or molded into the panels (10). The positioning hardware (55) may also be included at the rearward end (25) of the panels (10) and/or along the longitudinal edges (95) of the panels (10), instead of or in addition to at the front end (20) of the panels (10).

Figure 8:
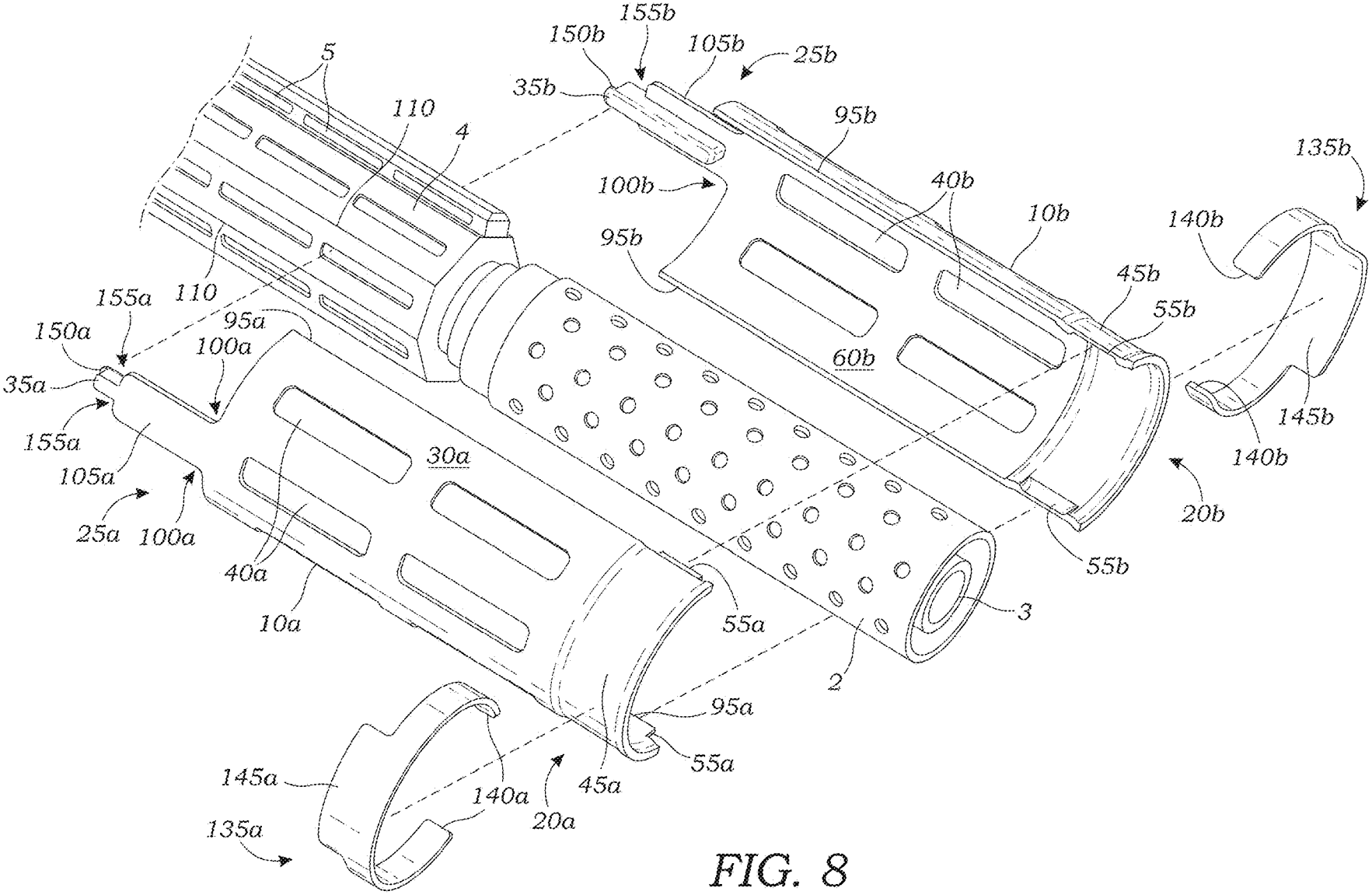
FIG. 8 is a perspective view of the panels of FIGS. 2-4 and the collar of FIGS. 6-7, in position to be installed on the rifle of FIG. 1.

As previously described, the panels (10) are configured to mate with each other to form a tube (70). This is best seen in FIGS. 4, 5, 8, and 11, showing the panels (10) aligning and contacting each other along their longitudinal edges (95). The tube (70) forms the body of the suppressor cover (200) and is held in place when installed on the rifle (1) by various frictional and compression forces, maintaining a circumferential gap of approximately ⅛ inch to ¼ inch between the inner surfaces (60) of the panels (10) and the outer surface of the suppressor (2), depending on the specific application. The forward ends (20) of the panels (10) combine to form a forward end (75) of the tube (70), and the rearward ends (25) of the panels (10) combine to form a rearward end (80) of the tube (70). The tube (70) is configured to cover a suppressor (2) installed on a rifle (1) when the locking tabs (35) are mated with the rail slots (5) to interlock therein as seen in FIG. 11. This is also shown in FIG. 8 as later described herein.

Figure 4:
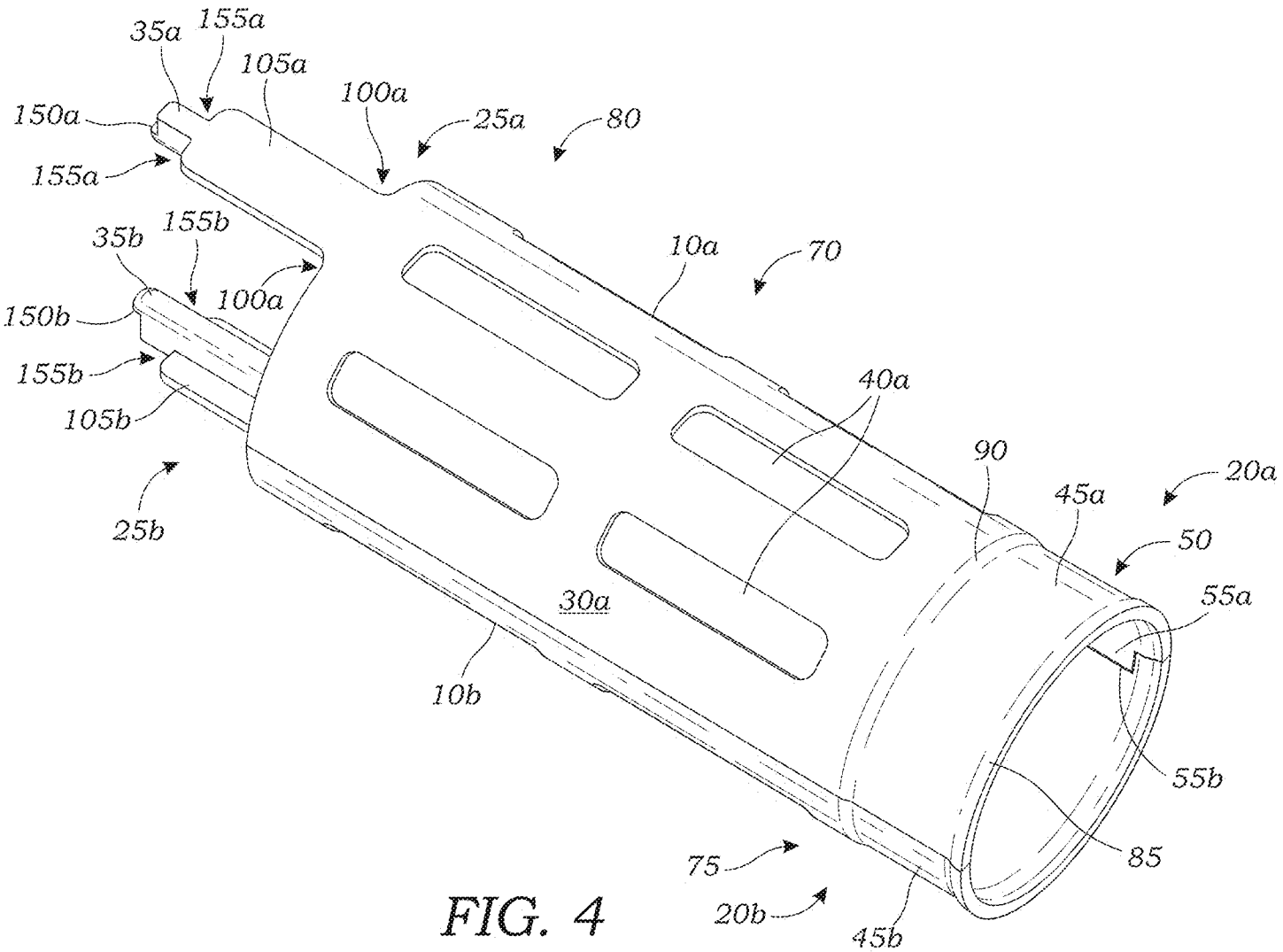
FIG. 4 is a perspective view of the outer surfaces of the panels of FIG. 2, with the panels mating to form a tube.

Turning now to FIG. 4, a perspective view of the outer surfaces (30) of the panels (10) of FIG. 2 is shown, with the panels (10) assembled and mating to form the tube (70). The tube (70) shown has a generally cylindrical transverse cross section for both the inner and outer diameters. This configuration is convenient to correspond to the shape and orientation of the suppressor (2) and to minimize potential obstruction of the shooter's view and/or operation of the rifle (1). However, the combined profiles of the panels (10) (and thus the corresponding inner and/or outer diameters of the tube (70)) may be any suitable shape, including rectangular, square, triangular, pentagonal, octagonal, star-shaped, etc. Such variations may be for aesthetics, or for functionality (e.g., to maximize ventilation, minimize obstruction, or serve as an additional tool). The tube (70) may be varying lengths, e.g.: covering the entire length of the suppressor (2); covering only part of the length of the suppressor (2); or extending beyond the length of the suppressor (2) at the forward end and/or the rearward end thereof. Such variations here may also be for aesthetics, or for functionality. The term "tube" is thus used herein to refer generally to the structure formed when the panels (10) contact along their longitudinal edges (95) and further mate via the positioning hardware (55), the "tube" structure being sufficient to shroud the suppressor (2) to achieve the goals of the invention as described herein.

Figure 5:
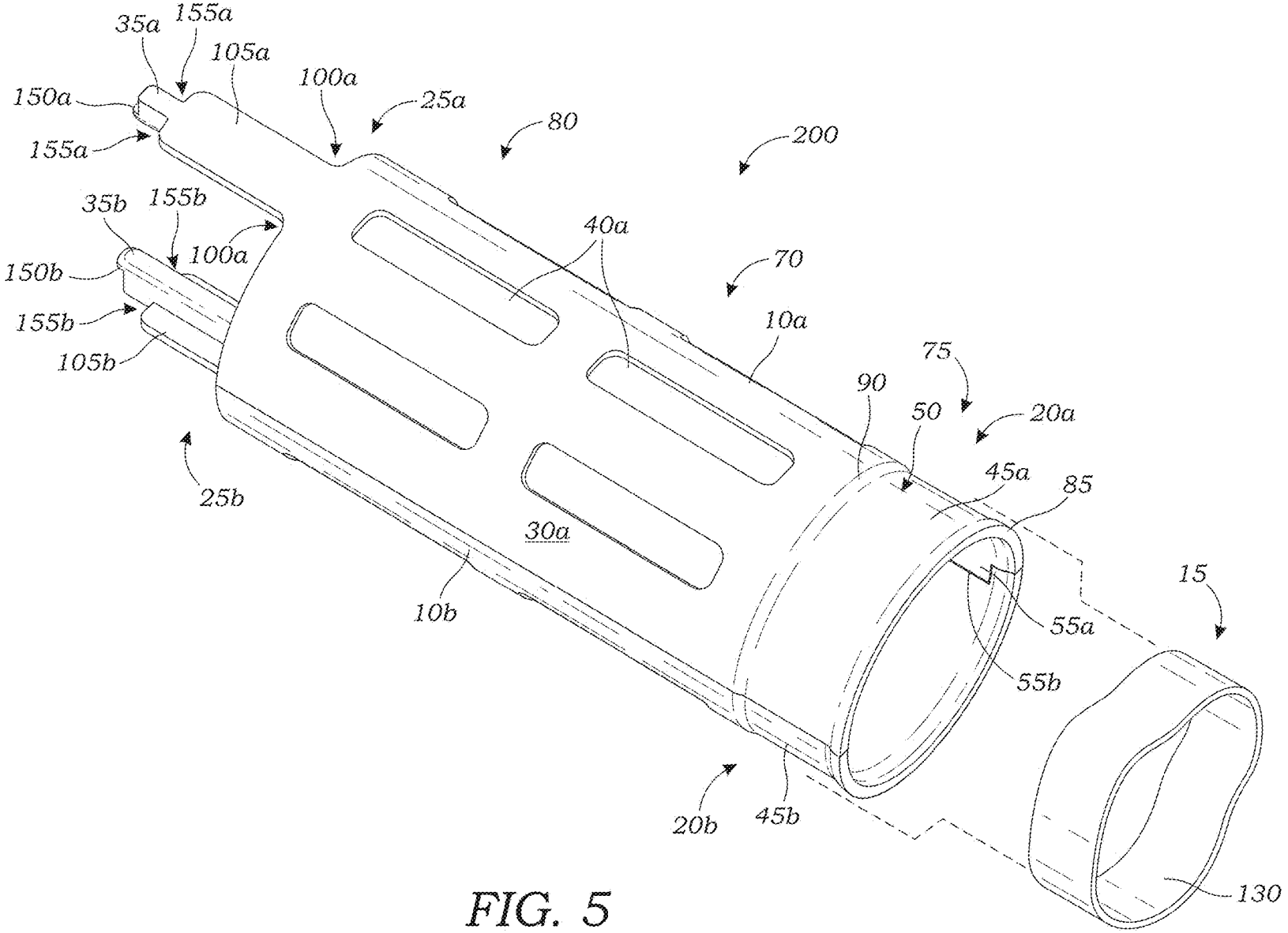
FIG. 5 is a perspective view of the panels of FIG. 4, showing an elastic collar in accordance with an embodiment of the present invention, in position to be placed around the forward end of the tube.

The recesses (45) of the panels (10) combine to form a circumferential recess (50) at the forward end of the suppressor cover (200), configured to receive the collar (15). The collar (15) is configured to wrap around the forward end (75) of the tube (70) within the circumferential recess (50), as seen in FIGS. 5, 8, and 11. The circumferential recess (50) results in forward (85) and rearward (90) lips at the forward end (75) of the tube (70) to help prevent the collar (15) from being dislodged.

Still referring primarily to FIG. 4, and also to FIG. 8, the panels (10) mate using positioning hardware (55) to form the tube (70). The positioning hardware (55) shown in the drawings consists of a positioning tab (55*a*) on panel (10*a*) and a positioning notch (55*b*) on panel (10*b*) both located at the forward ends (20) of the panels (10). However, other positioning hardware (55) may be used instead of or in addition to the tab (55*a*) and notch (55*b*), and such other hardware (55) may be located anywhere along the lengths of the panels (10). The positioning hardware (55) helps align the panels (10) during assembly (i.e., formation of the tube (70)) and also helps secure and stabilize the suppressor cover (200) during installation and use. Additional features similarly help, including the collar (15) which helps secure and stabilize the forward end of the suppressor cover (200), the locking tabs (35) which help secure and stabilize the rearward end of the suppressor cover (200), and/or lips (not shown) along the edges of fingerlike extensions (105) which also help secure and stabilize the rearward end of the suppressor cover (200).

Other features of the panels (10) are the stepped-down profiles (100) and (155) at the rearward ends (25) of the panels (10). The stepped-down profiles (100) result in the fingerlike extensions (105) so the tube (70) does not shroud the handguard (4) as it does the suppressor (2). This not only saves on material costs, but also has an operational advantage. Specifically, the extensions (105) are wide enough to carry and support the locking tabs (35) and be otherwise structurally sound but narrow enough not to obstruct other unused rail slots (5). This is best seen in FIG. 11 which shows specifically identified rail slots (5.1, 5.2) and analogously positioned rail slots (not seen) on the other side of the handguard (4) remaining available for use as opposed to being covered by the panels (10). The further stepped down profiles (155) provide extra workspace for the locking tabs (35) to be installed in the rail slots (5), as described herein.

The locking tabs (35) will now be described in more detail. The locking tabs (35) may be integrated with the panels (10) as seen in FIGS. 2, 3, 4, 5, 8 and 11, or they may be separate pieces attached to the panels (10) as seen in FIGS. 9 and 10. In embodiments in which the locking tabs (35) are integrated, they are machined, printed, molded, welded, soldered, or otherwise fabricated as part of the panels (10) such that a panel (10) and its corresponding locking tab (35) are a single physical component. The locking tabs (35) typically have smooth or rounded edges to help guide them into the rail slots (5), and typically the locking tabs (35*a*, 35*b*) on panels (10*a*, 10*b*) mate with rail slots (5) on opposite sides of the handguard (4), as best seen in FIG. 8.

The locking tabs (35) are positioned on the fingerlike extensions (105) to align and mate with corresponding rail slots (5) on the handguard (4), as best seen in FIG. 8. The locking tabs (35) are thus accordingly shaped to match the profile of the rail slots (5) on the particular rifle (1) for which the suppressor cover (200) is being used. For example, the locking tabs (35) may have a perimeter profile matching M-LOK, PICATINNY, KEYMOD, or other rail slot (5) profiles. The locking tabs (35) also have a ledge (150) extending rearwardly therefrom configured to abut against the inner surface of the hand guard (4) at the rearward edge of the corresponding rail slots (5) to which the locking tabs (35) interlock. The ledge (150) may be substantially flat or slightly curved to match the profile of the inner surface of the handguard (4) over the area of contact. The exact dimensions of a locking tab (35) may vary but should be sufficient to allow the locking tab (35) to mate with a corresponding rail slot (5) and securely interlock therewith. Securely in this sense means secure enough to maintain frictional, normal, and/or other forces within the perimeter edges of the corresponding rail slot (5) and/or with the inner surface (60) of the panel (10), to help secure and stabilize the rearward end of the suppressor cover (200) during installation and use, yet still allow simple manual detachment without the need for tools.

Properly forming the locking tabs (35) in position on the fingerlike extensions (105) and properly dimensioning the locking tabs (35) as described herein allows the locking tabs (35) to mate interlockingly with the rail slots (5) and secure the rearward ends (25) of the panels (10) to the handguard (4) without using any additional parts or tools. This enables efficient attachment/detachment in dynamic environments, which is crucial not only for military and law enforcement operations, but also for civilian use.

In some embodiments, the fingerlike extensions (105) have lips (not shown) along one or both edges configured to grip the handguard (4) to further secure and stabilize the suppressor cover (200). For example, with the handguard (4) shown in FIGS. 1, 8, and 11 having an octagonal profile, the fingerlike extensions (105) may include angled lips (not shown) to grip the nearest octagonal edges (110) of the handguard. In some embodiments, one or both panels (10) may have multiple locking tabs (35) positioned to mate with adjacent rail slots (5). In some such embodiments, e.g., using the rail slots (5) above and/or below the rail slot (5) used by the first locking tab (35) on a panel (10), the panel (10) may not include one or both stepped-down profiles (100) because the extra radial panel area would be needed to carry the additional locking tabs (35). In other such embodiments, e.g., using the rail slots (5) along the same longitudinal axis as the rail slot (5) used by the first locking tab (35) on a panel (10) but rearward thereto, the stepped down profiles (100) could be maintained and the fingerlike extensions (105) would be longer to accommodate the extra locking tabs (35). Such embodiments with additional locking tabs (35) might provide extra stability and a more secure fit for the suppressor cover (200), but in exchange would use up additional rail slots (5) that could then not be used for mounting other accessories, and might also complicate installation, repair and maintenance.

Figure 9A:
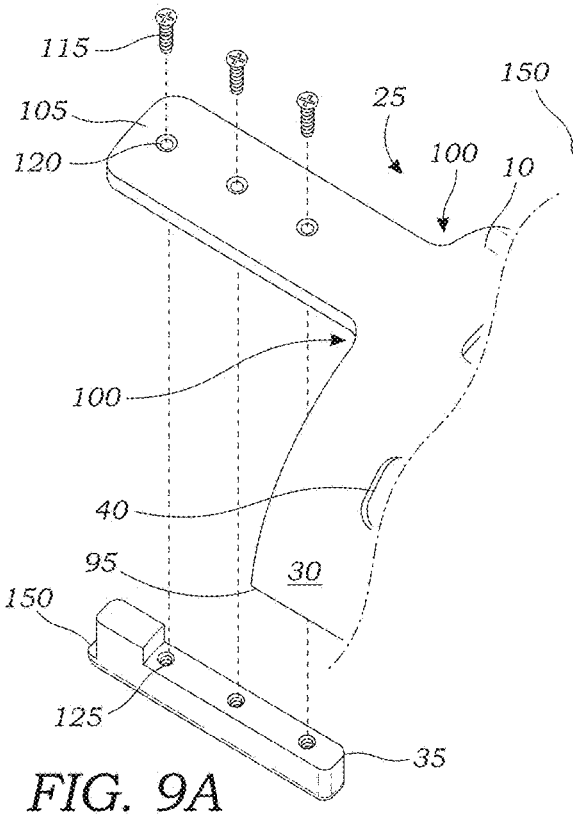
FIG. 9A is a close-up perspective view of the outer surface of the rearward end of a panel in accordance with an embodiment of the present invention, showing an alternate embodiment of a locking tab in position to be assembled onto the panel.
Figure 9B:
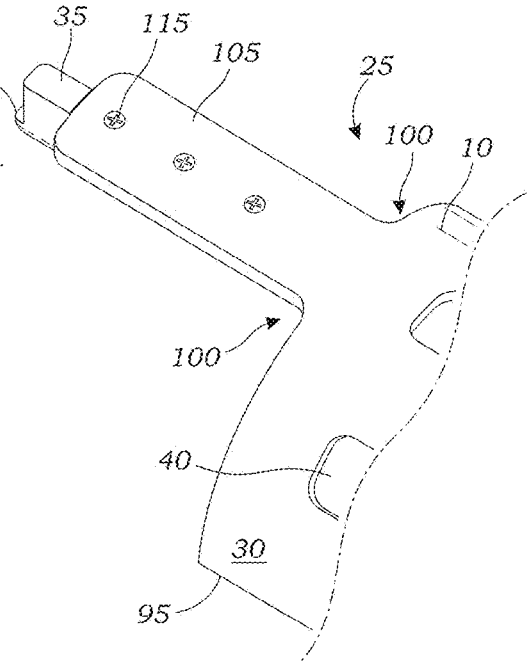
FIG. 9B shows the panel of FIG. 9A, with the locking tab assembled onto the panel.
Figure 10A:
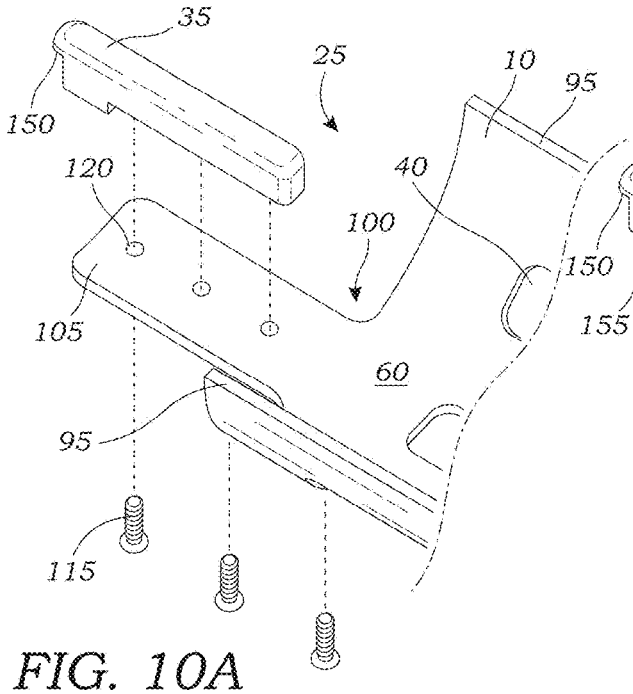
FIG. 10A is a close-up perspective view of the inner surface of the rearward end of the panel of FIG. 9A, showing the locking tab in position to be assembled onto the panel.
Figure 10B:
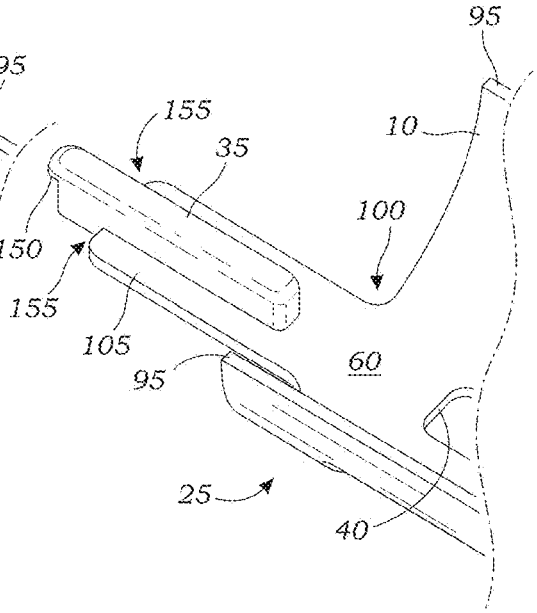
FIG. 10B shows the panel of FIG. 10A, with the locking tab assembled onto the panel.

Turning now to FIGS. 9A, 9B, 10A, and 10B, an embodiment of the locking tabs (35) is shown in which they are not integrated with the panels (10) but rather are separate pieces attached to the panels (10). FIG. 9A shows a close-up view of the outer surface (30) of the rearward end (25) of a panel (10) in accordance with this embodiment of a locking tab (35), with the locking tab (35) positioned to be attached onto the panel (10). In this embodiment, the locking tab (35) is mechanically secured to the fingerlike extension (105) of the panel (10) by screws (115) through holes (120) in the fingerlike extension (105) and into threaded bores (125) in the locking tab (35). The screws (115) and/or the locking tab (35) may be aluminum, carbon fiber, or other suitable material. FIG. 9B shows the panel (10) of FIG. 9A, with the locking tab (35) assembled onto the panel (10). FIGS. 10A and 10B show the panel (10) of FIGS. 9A and 9B respectively, viewed from the inner surface (60). Other mechanical and/or chemical attachments such as welding, soldering, gluing riveting, snapping, clipping, sliding (e.g., tongue and groove), etc., or any combination thereof, may be suitable for various applications.

The collar (15) will now be described in more detail. As previously described, the collar (15) is configured to wrap around the forward end (75) of the tube (70) to help secure and stabilize the forward end of the suppressor cover (200). The collar (15) maintains its grip on the forward end (75) of the tube (70) by spring and/or frictional forces and sits within the circumferential recess (50) as seen in FIGS. 5, 8, and 11. This helps prevent the collar (15) from dislodging or otherwise experiencing unwanted forward or rearward movement along the longitudinal axis of the suppressor cover (200) during use.

Turning to FIG. 5, the panels (10) of FIG. 4 are shown with an embodiment of the collar (15) that is a silicone band (130), in position to be placed around the forward end (75) of the tube (70). The silicone band (130) is heat resistant sufficient to withstand the extreme temperatures it will likely experience, up to approximately 250 degrees Fahrenheit. A silicone band (130) able to withstand temperatures between 500 and 600 degrees Fahrenheit will thus suffice. In this embodiment, the silicone band (130) is dimensioned to snugly fit within the circumferential recess (50) around the forward end (75) of the tube (70) with sufficient force to keep the panels (10) aligned laterally along their longitudinal edges (95) and aligned longitudinally such that the positioning hardware (55) maintains its mating configuration and the lips (85, 90) at the forward end (75) of the tube (70) remain radially aligned. The exact force required will vary depending on the nature, quantity, and locations of the positioning hardware (55), the locking tabs (35), and/or other features and components of the suppressor cover (200) and rifle (1).

Figure 6:
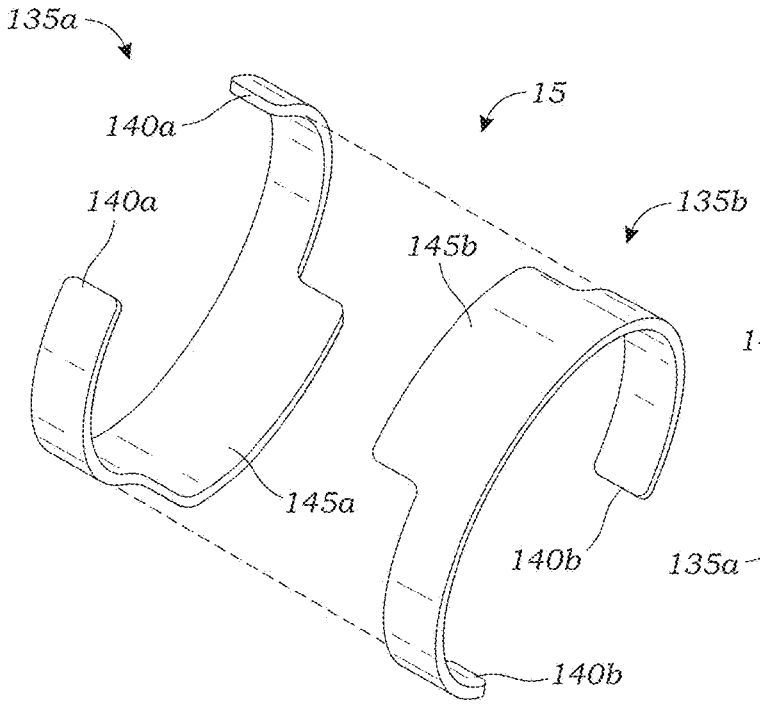
FIG. 6 is a perspective view of a two-piece collar in accordance with an embodiment of the present invention, in position to be assembled.
Figure 7:
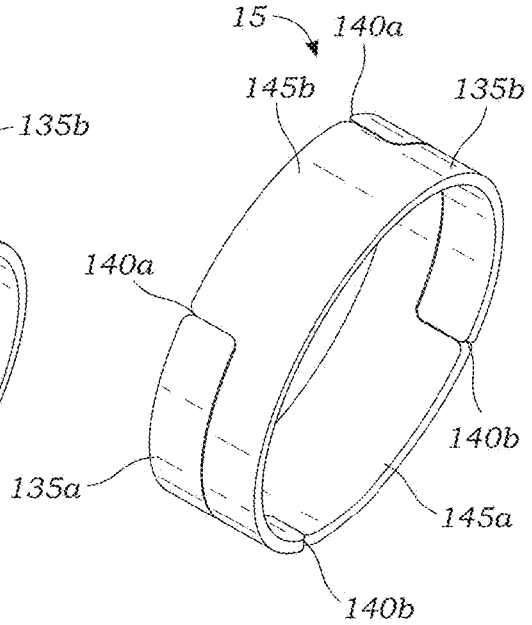
FIG. 7 is a perspective view of the collar of FIG. 6, assembled.

Turning now to FIG. 6, a two-piece embodiment of the collar (15) is shown, in position to be assembled by mating the two pieces (135*a*, 135*b*) with each other to form a ring, as seen in FIG. 7. The two pieces (135) in this embodiment have the same profile and are generally C-shaped with two terminal ends (140) and a stepped-up wall portion (145) at the middle of the back curve of the C-shape to help the two pieces (135) mate. Specifically, the terminal ends (140) of one of the generally C-shaped pieces (135) are configured to abut against the stepped-up wall portion (145) of the other generally C-shaped piece (135), and vice versa. For example, as seen in FIG. 7, the terminal ends (140*a*) of generally C-shaped piece (135*a*) are configured to abut against the stepped up wall portion (145*b*) of the generally C-shaped piece (135*b*), and the terminal ends (140*b*) of generally C-shaped piece (135*b*) are configured to abut against the stepped up wall portion (145*a*) of the generally C-shaped piece (135*a*). In this manner, the two pieces (135) mate and form a ring to act as the collar (15).

The two generally C-shaped pieces (135) are made from carbon fiber or other heat resistant, durable material and are configured to mate snugly with each other and around the forward end (75) of the tube (70). Accordingly, the generally C-shaped pieces (135) have an "at rest" inner diameter slightly less than the outer diameter of the circumferential recess (50) and a durable elasticity to allow the terminal ends (140) to open up or expand (i.e., separate further from each other along the plane of the C) upon sufficient force, such as when sliding, clipping, or otherwise placing them onto the panel recesses (45) or the combined circumferential recess (50) as applicable. The elastic force then naturally biases the generally C-shaped pieces (135) closed, thus tightening their grip on the of the panel recesses (45) or the combined circumferential recess (50) as applicable. Other mechanical mating connections can be used instead of or in addition to the generally C-shaped pieces (135) with stepped up wall portions (145). For example, the generally C-shaped pieces (135) can mate using notch and tab, interlocking teeth, pin and bore, tongue and groove, etc.

Turning now to FIG. 8, the panels (10) of FIGS. 2-4 and the two-piece collar (15) consisting of the generally C-shaped pieces (135) as shown in FIGS. 6-7, are shown in position to be installed around the suppressor (2) of the rifle (1) of FIG. 1. Once installed as such, the suppressor cover (200) is secured to the rifle as described herein and as seen in FIG. 11. This includes: the positioning hardware (55) mating to help keep the panels (10) aligned laterally along their longitudinal edges (95) and longitudinally such that the forward (85) and rearward (90) lips at the forward end (75) of the tube (70) are properly formed; the collar (15) gripping the circumferential recess (50) at the front end (75) of the tube (70) to also help keep the panels (10) aligned laterally and longitudinally; the locking tabs (35) interlocking with corresponding rail slots (5) to help secure and stabilize the rearward end (80) of the tube (70) (including the ledges (150) abutting against the inner surface of the handguard (4)); and/or lips (not shown) along the edges of the fingerlike extensions (105) gripping the edges (110) of the handguard. One way to install a suppressor cover (200) of the present invention is by first installing the panels (10), then the collar (15). For the panels (10), one panel (10) is first installed on one side of the handguard (4) by mating the panel's (10) locking tab (35) with a corresponding rail slot (5) on that side, then the other panel (10) is similarly installed on the opposite side of the handguard (4). To get the locking (35) tab to interlock with a rail slot (5), the panel (10) should be held in a position similar to the position shown in FIG. 8, but with the locking tab (35) contacting the corresponding rail slot (5). The panel (10) is then rotated or rocked rearward (toward the back end of the rifle (1)) at an angle between approximately 5 and 90 degrees (more typically between approximately 15 and 45 degrees) or at any angle suitable for the profile of the particular rifle (1) and handguard (4), while maintaining contact (or almost contact) between the locking tab (35) and the rearward edge of the corresponding rail slot (5). This is enabled by the step down (155) of the fingerlike extensions (105). The panel (10) is then pushed or driven rearward to position the ledge (150) of the locking tab (10) past the rearward edge of the rail slot (5). Next, the panel is rotated or rocked in the reverse direction to its operational position as seen in FIG. 11. As such, the properly-dimensioned locking tab (35) interlocks with the rail slot (5), snugly contacting the handguard (4) at substantially the entire perimeter of the rail slot (5) with the ledge (150) of the locking tab (35) abutting against the inner surface of the handguard (4) at the rearward edge of the rail slot (5). These contacts combine to help stabilize the suppressor cover (200) until fully installed and during use.

Although particular embodiments and aspects of the present invention have been shown and described, the present invention is not limited to the preferred embodiments. Rather, the invention is intended to cover alternatives, modifications, and equivalents as defined by the claims which follow.

What is claimed is:

1. A suppressor cover for a rifle comprising:

a first panel having a forward end and a rearward end;

a second panel having a forward end and a rearward end; and a collar;

wherein the first panel comprises a first locking tab at the rearward end of the first panel configured to mate with a first rail slot on a first side of a handguard installed on a rifle;

wherein the second panel comprises a second locking tab at the rearward end of the second panel configured to mate with a second rail slot on a second side of the handguard, the second side being opposite the first side;

wherein the first panel and the second panel are configured to mate with each other to form a tube with the forward end of the first panel and the forward end of the second panel combining to form a forward end of the tube and the rearward end of the first panel and the rearward end of the second panel combining to form a rearward end of the tube, the tube configured to cover a suppressor installed on the rifle when the first locking tab is mated with the first rail slot and the second locking tab is mated with the second rail slot; and wherein the collar is configured to wrap around the forward end of the tube.

2. The suppressor cover of claim 1, wherein the first panel has an air vent and the second panel has an air vent.

3. The suppressor cover of claim 1, wherein the rearward end of the first panel is stepped down resulting in a fingerlike extension that carries the first locking tab and the rearward end of the second panel is stepped down resulting in a fingerlike extension that carries the second locking tab.

4. The suppressor cover of claim 3, wherein the first locking tab comprises a ledge extending rearwardly therefrom configured to abut against an inner surface of the handguard at a rearward edge of the first rail slot and the second locking tab comprises a ledge extending rearwardly therefrom configured to abut against the inner surface of the handguard at a rearward edge of the second rail slot.

5. The suppressor cover of claim 1, wherein the forward end of the tube has a circumferential recess and the collar is configured to wrap around the forward end of the tube within the circumferential recess.

6. The suppressor cover of claim 5, wherein the collar comprises a silicone band.

7. The suppressor cover of claim 5, wherein the collar comprises a first piece and a second piece configured to mate with each other to form a ring.

8. The suppressor cover of claim 7, wherein the first piece of the collar is generally C-shaped and has a stepped up wall portion, the second piece of the collar is generally C-shaped and has a stepped up wall portion, terminal ends of the generally C-shaped first piece are configured to abut against the stepped up wall of the generally C-shaped second piece, and terminal ends of the generally C-shaped second piece are configured to abut against the stepped up wall of the generally C-shaped first piece.

9. The suppressor cover of claim 1, wherein the collar comprises a first piece and a second piece configured to mate with each other to form a ring.

10. The suppressor cover of claim 9, wherein the first piece of the collar is generally C-shaped and has a stepped up wall portion, the second piece of the collar is generally C-shaped and has a stepped up wall portion, terminal ends of the generally C-shaped first piece are configured to abut against the stepped up wall of the generally C-shaped second piece, and terminal ends of the generally C-shaped second piece are configured to abut against the stepped up wall of the generally C-shaped first piece.

11. The suppressor cover of claim 10, wherein the first locking tab is integrated with the first panel and the second locking tab is integrated with the second panel.

12. The suppressor cover of claim 10, wherein the first locking tab is mechanically attached to the first panel and the second locking tab is mechanically attached to the second panel.

13. A suppressor cover for a rifle comprising:

a first panel having a forward end and a rearward end;

a second panel having a forward end and a rearward end; and a collar;

wherein the first panel comprises a first locking tab at the rearward end of the first panel configured to mate with a first rail slot on a first side of a handguard of a rifle;

wherein the first panel has an air vent;

wherein the second panel comprises a second locking tab at the rearward end of the second panel configured to mate with a second rail slot on a second side of the handguard, the second side being opposite the first side;

wherein the second panel has an air vent;

wherein the first panel and the second panel are configured to mate with each other to form a tube with the forward end of the first panel and the forward end of the second panel combining to form a forward end of the tube having a circumferential recess, the rearward end of the first panel and the rearward end of the second panel combining to form a rearward end of the tube, the tube configured to cover a suppressor installed on the rifle when the first locking tab is mated with the first rail slot and the second locking tab is mated with the second rail slot; and wherein the collar is configured to wrap around the forward end of the tube within the circumferential recess.

14. The suppressor cover of claim 13, wherein the rearward end of the first panel is stepped down resulting in a fingerlike extension that carries the first locking tab and the rearward end of the second panel is stepped down resulting in a fingerlike extension that carries the second locking tab.

15. The suppressor cover of claim 14, wherein the first locking tab comprises a ledge extending rearwardly therefrom configured to abut against an inner surface of the handguard at a rearward edge of the first rail slot and the second locking tab comprises a ledge extending rearwardly therefrom configured to abut against the inner surface of the handguard at a rearward edge of the second rail slot.

16. The suppressor cover of claim 13, wherein the collar comprises a first generally C-shaped piece having a stepped up wall portion and a second generally C-shaped piece having a stepped up wall portion, the generally C-shaped first piece and the generally C-shaped second piece configured to mate with each other to form a ring with terminal ends of the generally C-shaped first piece abutting against the stepped up wall of the generally C-shaped second piece, and terminal ends of the generally C-shaped second piece abutting against the stepped up wall of the generally C-shaped first piece.

17. The suppressor cover of claim 16, wherein the first locking tab comprises a ledge extending rearwardly therefrom configured to abut against an inner surface of the handguard at a rearward edge of the first rail slot and the second locking tab comprises a ledge extending rearwardly therefrom configured to abut against the inner surface of the handguard at a rearward edge of the second rail slot.

18. The suppressor cover of claim 13, wherein the first panel has longitudinal edges, the second panel has longitudinal edges, the first panel and the second panel are configured to mate with each other by a tab and a notch at the forward end of the tube, and the first panel and the second panel are configured to align with and contact each other along their respective longitudinal edges when the tab mates with the notch.

19. The suppressor cover of claim 13, wherein the first locking tab is mechanically attached to the first panel and the second locking tab is mechanically attached to the second panel.

20. The suppressor cover of claim 13, wherein the first locking tab is integrated with the first panel and the second locking tab is integrated with the second panel.

* * * * *